US005172026A

United States Patent [19]

Hall et al.

[11] Patent Number: 5,172,026

[45] Date of Patent: Dec. 15, 1992

[54] PLUG IN LAMP

[76] Inventors: Rolland B. Hall, 11 Partridge Berry La., Keene, N.H. 03431-2125; John A. Bergin, R.F.D. #1, Box 829, Hancock, N.H. 03449

[21] Appl. No.: 525,805

[22] Filed: May 21, 1990

[51] Int. Cl.[5] ..... H01J 5/48; H01J 5/50

[52] U.S. Cl. ..... 313/318; 313/113; 439/617

[58] Field of Search ..... 313/318, 113; 362/267; 439/617

[56] References Cited

U.S. PATENT DOCUMENTS 3,960,278 6/1976 Vause ..... 313/318
4,012,658 3/1977 Vause ..... 313/318
4,528,619 7/1985 Dolan et al. ..... 362/267
4,569,005 2/1986 Bergin et al. ..... 313/318
4,947,082 8/1990 French ..... 313/318

*Primary Examiner*—Donald J. Yusko
*Assistant Examiner*—Brian Zimmerman

[57] ABSTRACT

A plug in lamp having a base to support a light source is described. The base includes electrical connectors on the light source side of a hermetic seal. The electrical connection is then made between the base, and a socket formed for the base so the connecting elements are sealed on the lamp side of the interface between the base and socket.

17 Claims, 4 Drawing Sheets

PLUG IN LAMP

1. TECHNICAL FIELD

The invention relates to electric lamps and particularly to bases for small electric lamps. More particularly the invention is concerned with a socketless base for a small electric lamp.

2. BACKGROUND ART

Automobile taillights are subject to a number of demanding requirements. The lamps must be inexpensive. The lamps must be assembled into vehicles during manufacture without great effort. The lamps must also be replaceable by a customer. Nonetheless, the lamps must still survive the temperature, weather, and road condition extremes typical of automobile use. In particular, this means the electrical contacts must survive the water, oil, salt, and dirt that are continually being blasted around the lamp housings. There is then a need for an inexpensive, durable vehicle taillight.

DISCLOSURE OF THE INVENTION

A plug in lamp comprising may be formed as a light source having an light transmissive envelope, and electrical leads, a base, having an inner side with a support for the envelope, having a lead channel extending from the support to a cavity defined within the base. The base is coupled to a portion of the light source to support the light source, with at least one electrical lead threaded through the lead channel to emerge in the defined cavity. At least one electrical connector, having a first connection end, and a second connection end is electrically coupled to the electrical lead. A circumferential sealing means is formed along the surface of the base, separating the surface of the base into an inner side adjacent the light source support, and an outer side; the sealing means defining a geometric circumference sufficient to allow the light source and support to pass therethrough. The first connection end of at least one electrical connector emerges from the base on the inner side of the base for electrical connection. The envelop, leads, and connections are then all sealed from environmental influences.

BEST MODE FOR CARRYING OUT THE INVENTION

Figure 1:
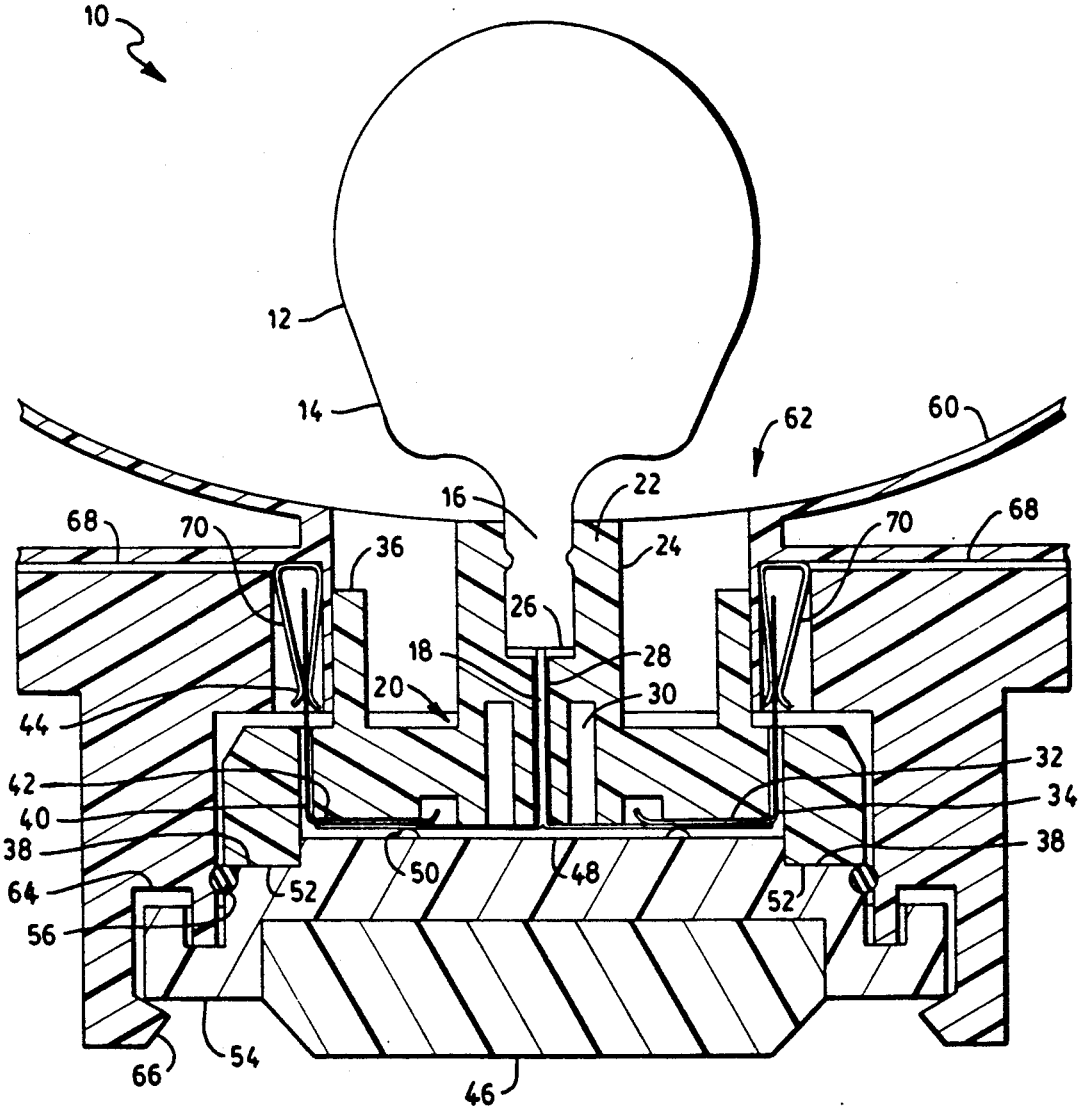
FIG. 1 shows a cross sectional, partially broken away view of a preferred embodiment of a light source, base and reflector.

FIG. 1 shows a cross sectional view, partially broken away of a preferred embodiment of a lamp 10, having a light source 12 held in a base 20 and reflector housing 60. The plug in lamp 10 is assembled from a light source 12, a base 20 comprising in the preferred embodiment ,of an inner base 22 and an outer base 46, and electrical connectors 40. The base 20 may be completed with a seal element. such as an O-ring 56.

FIG. 1 shows a light source 12. The light source 12 has a light transmissive envelope 14, with electrical leads 18. By way of example light source 12 is shown with a bulbous glass envelope 14 having a press seal 16 with two or more electrical leads 18 extending from the press seal 16. The press sealed lamp 12 may be of any suitable cross sectional configuration, such as the pear shaped or tubular lamps commonly used.

FIG. 1 shows a two piece base 20 comprising an inner base 22 and an outer base 46. The preferred inner base 22 is formed from a moldable, insulative material, such as plastic, for example polyamide nylon. The preferred inner base 22 has an extension 24, a support cavity 26, lead channels 28, one or more vibration suppressing cavities 30, an inner connection face 32, connector channels 34 and an inner sealing face 38. The light source 12 is supported from the inner base 22 by the extension 24. The extension 24 may take the form of any number of known support structures. The preferred embodiment is similar to the molded plastic structure shown in U.S. Pat. No. 4,210,173 to Daniel Devir. The preferred extension 24 then has a generally rectangular support cavity 26 to recieve the press seal 16 of the light source 12, and side slits to make the support cavity 26 pliable. Internal coupling elements may be formed in the rectangular support cavity 26 to snap together with complementary features formed on the press seal 16. The light source 14 may then be readily, and securely positioned with respect to the extension 24. Extending through the extension 24 are the lead channels 28. Each lead channel 28 may be a formed passage, groove, or other means for ducting leads 18 from the press seal 16 through or along the surface of the inner base 22. In the preferred embodiment, adjacent an end of the press seal 16, the leads 18 enter the lead channels 28 to emerge from the inner base 22 near the inner connection face 32. The inner connection face 32 is a surface region of the inner base 22 where the leads 18 are electrically coupled. In the preferred embodiment, the inner connection face 32 is an approximately planar face of the inner base 22 on a side opposite the side facing the light source 12. Connecting to the inner connection face 32 are also connector channels 34. Formed in the inner base 22, the connector channels 34 may have the form of grooves, or passages whose purpose is to position electrical connectors 40. In the preferred embodiment, the connection channels 34 are narrow passages extending from the inner connection face 32 through the inner base 22 to a contact region. By way of example inner base 22 is shown generally as a cylindrical inner base with an axial lamp support, although it may be of any other suitable configuration.

The inner base 22 may also include formed features to couple with the reflector housing 60. The formed features then help orient the lamp 10 with respect to the reflector housing 60. Such keying structures are well known, and are not shown. The inner base 22 may also include projecting guards 36 to protect the exposed ends of the electrical connectors 40 from unwanted contacts. If the lamp 10 is stored in bulk, or if inaccurately inserted in a reflector housing 60, direct contact with an unguarded electrical connector 40 may inadvertently bend the exposed end of the electrical connector 40. The exposed ends of electrical connectors 40 are then preferably protected from misaligned insertion and bending by the guards 36.

The inner base 22 may also include vibration damping cavities. A vehicle may induce a harmonic vibration in a light source 12, subjecting the light source 12 to extreme wear. By sculpting the support structures such as the inner base 22 and in particular the coupling around the extension 24 and extension 24 itself, detrimental harmonic stimulation may be damped. In particular, cavities may be sculpted in the inner base 22 to damp particular vibration ranges natural to a particular vehicle, or class of vehicles. In particular, cavities may be sculpted adjacent the base of the extension 24, or along the length of the extension 24.

The preferred embodiment of the inner base 22 also includes an inner sealing surface 38. In the preferred embodiment, around the lead channel 28, the inner connection face 32, and the connector channels 34 is a perimeteral inner sealing face 38. Any appropriate sealing face design may be chosen, for example a flat ring portion, or tubular section able to bonded to a complementary sealing face.

FIG. 1 shows electrical connectors 40. The inner base 22 supports the electrical connectors 40. The electrical connectors 40 have first connection points 42, and displaced from the first connection points are second connection points 44. The preferred embodiment the electrical connectors 40 are L shaped lugs formed from flat brass. Adjacent the inner connection face 32 is the first connection point 42 formed on one arm of the L shaped lug. The preferred second connection point 44 is on the opposite arm of the L extending through the connector channel 34 and exposed as a blade connector on the side of the inner base adjacent the light source 12. The inner base 22 and the electrical connectors 40 may be molded together or staked in place depending on the assembly method that satisfies the users balance between cost and accuracy. In the preferred embodiment, the inner base 22 and electrical connectors 40 are staked together, thereby accurately anchoring the inner base 22, and electrical connectors 40. Molding assures a hermetic seal between the inner base 22 and electrical connectors 40.

FIG. 1 shows a outer base 46. The electrical connectors 40 first connection points 42 are positioned adjacent the outer base 46. The preferred outer base 46 is formed from a moldable, insulative material, such as plastic, for example polyamide nylon. The preferred outer base 46 has an outer connection face 48, pressuring bumps 50, an outer sealing face 52, and a base coupling 54. Positioned opposite the inner connection face 32 is the outer connection face 48. In the preferred embodiment, on the surface of the outer connection face 48 are bumps 50. The bumps 50 are large enough to contact the leads 28 when the inner base 22 and outer base 46 are sealed to each other. The bumps 50 then press against the leads 18 to hold the leads 28 against the electrical connectors 40. The inner sealing face 38 couples to the outer sealing face 52 to form a seal around the inner connection face 32 and outer connection face 48 thereby enclosing the connections between the leads 28 and electrical connectors 40. Coupling the inner base 22 and the outer base 46 forms a combined base with a defined cavity that contains the electrical coupling between the leads 18 and electrical connectors 40. The defined internal cavity encloses, and protects the electrical connection.

The preferred base coupling 54 is formed along the exterior of either the inner base 22,the outer base 46 or a combination of both. In the preferred embodiment, the base coupling 54 is formed along a perimeter of the outer base 46. In particular the preferred base coupling 54 is a perimeteral lip ring facing the reflector housing 60.

A sealing means, such as an O-ring 56 may also be positioned along the interface of the inner base 22 and outer base 46 portions to provide a hermetic seal between the base 20 and the reflector housing 60. The inner base, and outer base may be coupled to form a combined base. Conversely, a combined base with an included cavity, may be divided to form an inner base, and an outer base. The relevant feature is the defined internal cavity shields the electrical connection. In the preferred embodiment, the sealing means is formed along the surface of the base extending circumferentially around the base, and separating the surface of the base into an inner side including the light source support and one or more of the exposed electrical connections; and an outer side. The sealing means also defines a geometric circumference sufficient to allow the light source and support to pass through. Since the envelope and support are inserted through the seal, the seal must define and opening large enough for passage. In the preferred embodiment, the first connection end of at least one electrical connector emerges from the base on the inner side of the base. By way of example outer base 46 is shown as an O-ring positioned in a groove along the exterior ends of the inner sealing face 38 and outer sealing face 52. The outer base 46 may also include a key structure to enhance the structural integrity of the base. A key on the outer base 46 also provides a rotative locator for use in assembling the inner base 26 with the outer base. A key on the outer base 46 also provide means for aligning the outer base with respect to a reflector housing, and may enhance insertion and removal from the reflector housing.

Figure 2:
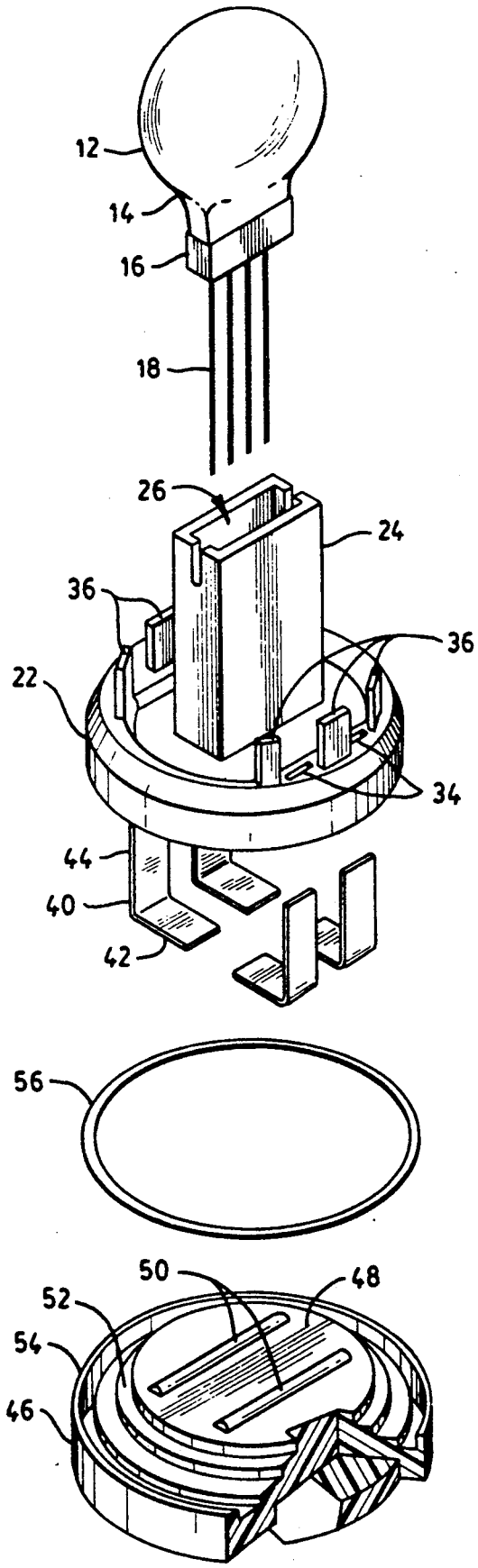
FIG. 2 shows an exploded view of a preferred embodiment of a plug in lamp and lamp base.
Figure 3:
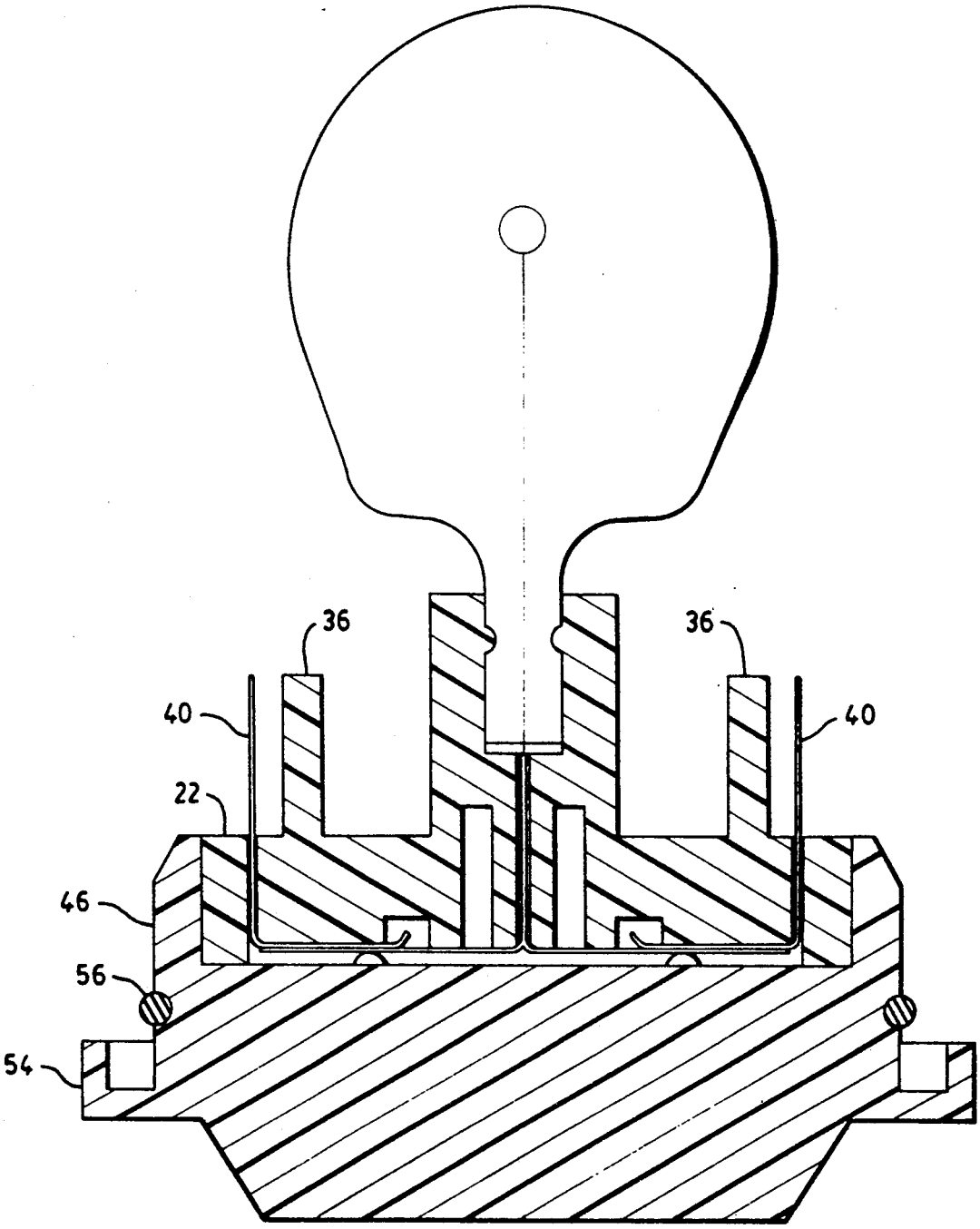
FIG. 3 shows a cross sectional, partially broken away view of an alternative preferred embodiment of a light source, base and reflector.
Figure 4:
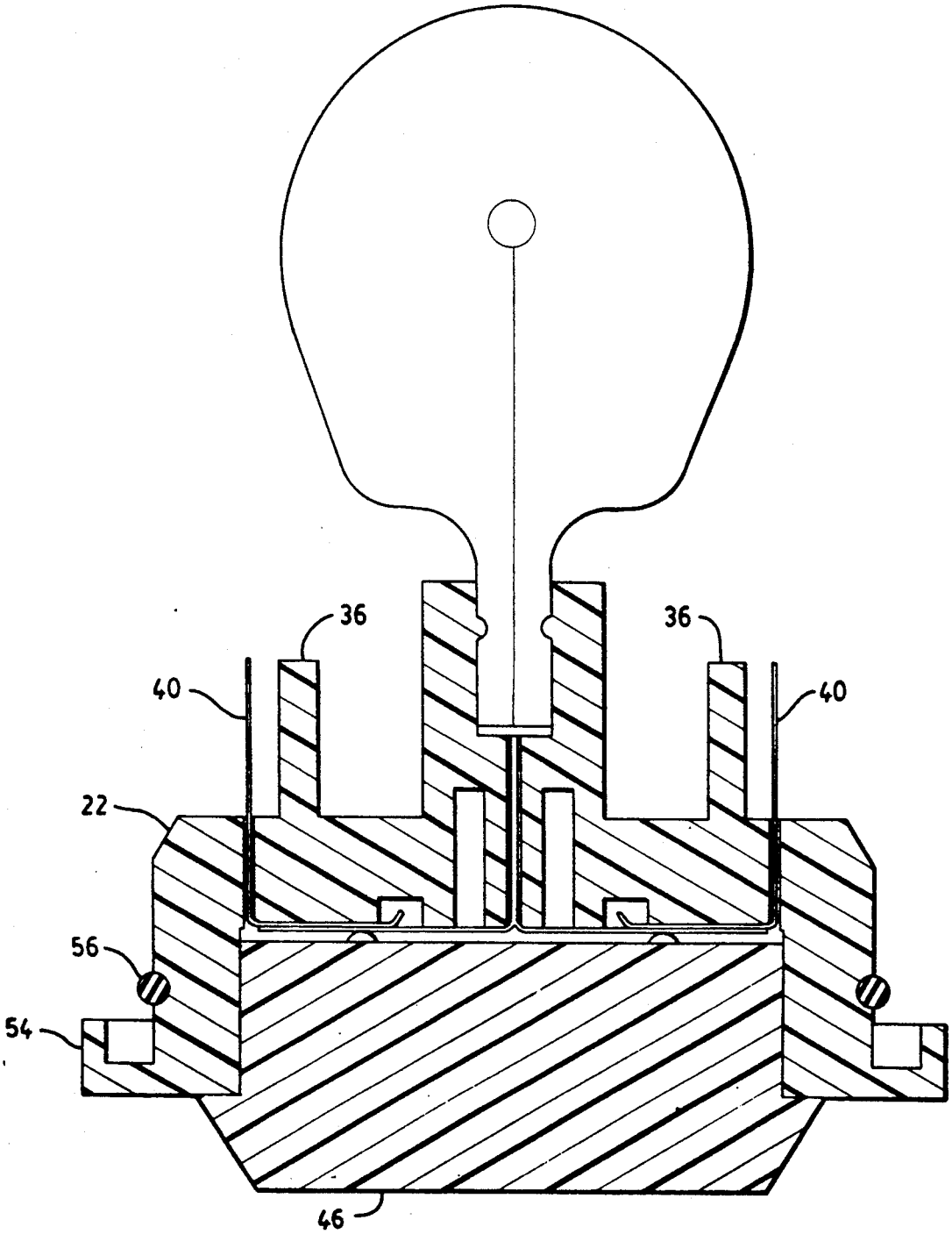
FIG. 4 shows a cross sectional, partially broken away view of an alternative preferred embodiment of a light source, base and reflector.

FIG. 2 shows an exploded view of a preferred embodiment of a plug in lamp 12 and lamp base 20. FIG. 3 shows a cross sectional, partially broken away view of an alternative preferred embodiment of a light source, base and reflector. The inner base has been structured as a plug that is fitted in a complementary opening formed in the outer base. FIG. 4 shows a cross sectional, partially broken away view of an alternative preferred embodiment of a li9ht source, base and reflector. The outer base has been structured as a plug that is fitted in a complementary opening formed in the inner base.

The first step in assembling the lamp 10 is to insert the electrical connectors in the inner base 22. The electrical connectors 40 are guided through the connector channels 34 and inserted so the first connection points 42 lie flat against the inner connection face 32. In the preferred embodiment, the inner base 22 the electrical connectors 40 are inserted, or staked in passages formed in the inner base 22, thereby securely anchoring the inner base 22, and electrical connectors 40. Staking the electrical connectors 40 assures accurate positioning and thereby avoids the possibility of insertion failure in a reflector housing with close tolerances.

The second step is to insert a light source into the inner base 22. The leads 18 are threaded through the lead channels 28 and then individually folded over a respective electrical connector 40 adjacent the respective first connection point 42. In the preferred embodiment, the press seal 16 of the light source snaps in place in the extension 24. In an alternative embodiment, alignment of the light source with respect to the inner base 22 may be required. The leads 18 are then electrically coupled to their respective electrical connectors 40 at the first connection points 42, by for example welding the leads 18 to the electrical connectors 40. The inner base 22 and outer base are then mated. In the preferred embodiment, the inner base 22 and outer base are placed adjacent each other along the respective inner sealing face 38 and outer sealing face 52. Coupling the inner base 22 and outer base 46 causes the sealing bumps 50 to press the leads 18 against the electrical connectors 40, so even if a weld should fail, a strong mechanical coupling still holds the lead 18 against the electrical connector 40 for electrical connection. With the inner base 22 positioned against the outer base 46, the two are sonically welded, causing a melt fusion weld to occur along the respective sealing faces. The melt fusion causes a hermetic seal that substantially hides the electrical connection from the exterior.

In the preferred embodiment, an O-ring 56 is then positioned around the exterior surface of the base, in the region where the base faces the reflector housing 60. The lamp is then complete.

With the lamp 12 assembled with the socketless lamp base 20, the envelope 14 may be threaded through a hole in a reflector housing 60. The reflector housing hole is formed to be complementary with the sealing means for the base. The envelope 14, support 18, and the exposed electrical connectors then fit through the hole to be on the inner side of the perimeter seal of the base. The exterior faces of the base 20 may be complementary with or keyed to the base 20 reflector housing 60 to position the base 20 with respect to the reflector housing 60. In the preferred embodiment, the base coupling 50 lip on the outer base 46 mates with a complementary coupling lip 64 formed on the reflector housing 60. A flexible snap ring 66 on the reflector housing 60 is spread to allow the base 20 to couple with the with reflector housing 60. The snap ring 66 then closes along the exterior face of the base 20 to pin and hold the base 20 in the coupled position.

Simultaneously with coupling the base 20 with the reflector housing 60, the exposed second connection points 44 mate with electrical contacts formed in the reflector housing 60. In the preferred embodiment, the exposed second connection points 44 mate with female clips 70 embedded in the reflector housing 60. Electrical power is delivered through the female clips 70. The electrical contact for the lamp base 20 is thereby made inside the hermetically sealed region between the lamp base 20 and reflector housing 60. There is then no socket extending from the rear of the lamp base 20 to which an electrical connection may be made. The outer side of the combined base may be exposed to harsh elements, but the envelope 14, and exposed ends of the electrical connectors 46 are well protected on the inner, sealed side of the base. The lamp 12 and base 20 are replaceable as a unit. The same action of plugging the lamp 12 into the rear of the reflector housing 60, plugs the electrical connectors 40 into the embedded female connectors 70, and seals the interface between the base 20 and reflector housing 60.

In a working model some of the dimensions were approximately as follows: The bulb had a pear shape with a transverse diameter of 25.4 millimeters. The filament was offset from the top of the bulb by 14.5 millimeters. The inner base had an axial length of about 2.5 centimeters, and an outer diameter of 44.7 millimeters. The inner base included vibration suppressing cavities with a width of about 2 or 3 millimeters, and a depth of about 9 millimeters. The lamp leads extended through a central shaft portion of the inner base to an internal cavity former between the inner and outer bases. The leads were then welded to electrical connectors, and additionally pressed to the electrical connectors by bumps formed on the inner surface of the outer base. The electrical connectors were L shaped brass lugs that were staked in the inner base and extended about 9.53 millimeters above the surface of the inner connector in the direction of the bulb. Protection prongs also extended from the inner base adjacent the exposed ends of the electrical connectors to protect against inadvertent or damaging contact of the electrical connectors. The outer base had an axial length of about 18 millimeters, and an outer diameter of 50.52 millimeters. The outer base had a circumferential lip ring facing the bulb side of the base. An O-ring seal was positioned along the exterior seam between the inner and outer bases. The inner base and outer base were formed from a plastic, Zytel provided by DuPont Corporation. With the above working example, the lamp bulb oould be fitted through a back opening, and the electrical connectors plugged into electrical socket connectors. The whole assembly was sealed and enclosed from environmental affects. The disclosed dimensions, configurations and embodiments are as examples only, and other suitable configurations and relations may be used to implement the invention. In particular, the disclosed dimensions are expected to be scaled down for final production.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A plug in lamp comprising:

a) a light source having a light transmissive envelope, and electrical leads, b) a base, having an inner side with a support for the envelope, having a lead channel extending from the support to a closed cavity defined within the base, the base being coupled to a portion of the light source to support the light source, with at least one electrical lead threaded through the lead channel to emerge in the defined cavity, c) at least one electrical connector, having a first connection end to receive supplied electric power, and a second connection end electrically coupled to the electrical lead, and d) a circumferential sealing means formed along the surface of the base, separating the surface of the base into an inner side adjacent the light source support, and an outer side; the sealing means defining a geometric circumference sufficient to allow the light source and support to pass therethrough; the first connection end of at least one electrical connector emerging from the base on the inner side of the base for electrical connection.

2. The apparatus in claim 1, wherein the electrical connectors has a second connection point intermediate the first connection end, and the second connection end.

3. The apparatus in claim 1, wherein the base is formed from an inner base having an inner connection face and an outer base having an outer connection face, the inner base and the outer base being mateable to define the cavity substantially between the inner connection face and the outer connection face.

4. The apparatus in claim 3, wherein the inner base includes extensions parallel to and adjacent with the first connection end to ward off bending contact with the first connection end.

5. The apparatus in claim 1, wherein the base includes vibration suppressing cavities.

6. The apparatus in claim 1, wherein the electrical connector has a second connection point intermediate the first connection end, and the second connection end.

7. The apparatus in claim 1, wherein the base ncludes compression contacts adjacent the lead emerging in the defined cavity and the electrical connector to press the lead against the electrical connector, and in turn the electrical connector against the base.

8. The apparatus in claim 1, wherein the base includes an O-ring positioned around an exterior surface to make a hermetic seal between the exposed first connection end and the outer side when the base is positioned in a holder.

9. The apparatus in claim 1, wherein the base includes at least one lead channel, and the electrical connector extends throughout the lead channel to expose the first connector end on the side of the base.

10. A plug in lamp comprising:

a) a light source having a light transmissive envelope, and electrical leads, b) an inner base, having an inner side with a support for the envelope, having a lead channel extending from the support through the inner base to an inner sealing face formed on the inner base, the inner base being positioned about a portion of the light source to support the light source, with at least one electrical lead threaded through the lead channel to emerge adjacent the inner sealing face, c) at least one electrical connector, having a first connection end to receive supplied electric power, and a second connection end electrically coupled to the electrical elad to form an electrical connection, and d) an outer base, having an outer sealing face, the outer base being coupled to the inner base to enclose the electrical connection between the electrical lead and the electrical connector between the iner sealing face and the outer sealing face, thereby forming a combined base for the light source, the first cfonnection end of the electrical connector emerging from the combined base on the inner side of the combined base.

11. The apparatus in claim 10, wherein the inner base includes extensions parallel to and adjacent with the first connection end to ward off bending contact with the first connection end.

12. The apparatus in claim 10, wherein the inner base includes at least one lead channel, and the electrical connector extends throughout the lead channel to expose the first connector end on the inner side of the inner base.

13. The apparatus in claim 10, wherein the inner base includes vibration suppressing cavities.

14. The apparatus in claim 10, wherein the electrical connectors, each have a second connection point intermediate the first connection end, and the second connection end.

15. The apparatus in claim 10, wherein the outer base includes compression contacts adjacent the lead emerging in the defined cavity and the electrical connector to press the lead against the electrical connector, and in turn the electrical connector against the inner base.

16. The apparatus in claim 10, wherein the base includes an O-ring positioned around an exterior surface to make a hermetic seal between the exposed first connection end and the outer side when the base is positioned in a holder.

17. The apparatus in claim 10, wherein the electrical connector has a second connection point intermediate the first connection end, and the second connection end.

* * * * *